United States Patent [19]

Rudolph

[11] 4,180,387

[45] Dec. 25, 1979

[54] PROCESS FOR REMOVING SLAG DURING PRESSURE GASIFICATION OF SOLID FUELS

[75] Inventor: Paul Rudolph, Bad Homburg, Fed. Rep. of Germany

[73] Assignee: Metallgesellschaft Aktiengesellschaft, Frankfurt, Fed. Rep. of Germany

[21] Appl. No.: 929,137

[22] Filed: Jul. 28, 1978

[30] Foreign Application Priority Data

Aug. 30, 1977 [DE] Fed. Rep. of Germany ..... 2738932

[51] Int. Cl.[2] ..... C10J 3/08

[52] U.S. Cl. ..... 48/206; 48/DIG. 2; 252/373; 266/88; 266/195

[58] Field of Search ..... 48/197 R, 202, 206, 48/DIG. 2, 210; 252/373; 122/235 N; 266/88, 195, 197, 236, 85; 201/38; 110/165 R, 266

[56] References Cited

U.S. PATENT DOCUMENTS

| | | | |
|---|---|---|---|
| 1,146,627 | 7/1915 | Koppers | 48/DIG. 2 |
| 2,716,598 | 8/1955 | Moses | 48/DIG. 2 |
| 3,218,998 | 11/1965 | Fairman et al. | 110/165 R |

*Primary Examiner*—S. Leon Bashore

*Assistant Examiner*—Peter F. Kratz

*Attorney, Agent, or Firm*—Sprung, Felfe, Horn, Lynch & Kramer

[57] ABSTRACT

In the gasification of granular solid fossil fuel in a reactor wherein the fuel forms a fixed bed moving from top to bottom of the reactor under gravity, oxygen-containing gases and water vapor are fed into the fuel bed through nozzles in the lower portion of the reactor, molten slag at a temperature of about 1350° to 1500° C. is discharged through a conduit which is inclined to the horizontal, and product gas is withdrawn from the reactor above the fuel bed, the improvement which comprises feeding oxygen gas into the reactor adjacent to the inlet of the slag discharge conduit and directed from above onto the molten slag, thereby forming a leakage gas at a temperature of at least about 1500° C. which leakage gas is withdrawn through the slag discharge conduit co-current with the slag. The leakage gas is separated from the slag in a lock chamber and mixed with the product gas. The temperature and/or composition of the leakage gas in the slag discharge conduit may be used to control the rate at which leakage is produced. A corresponding apparatus is described. This simplifies slag discharge and prevents clogging.

2 Claims, 1 Drawing Figure

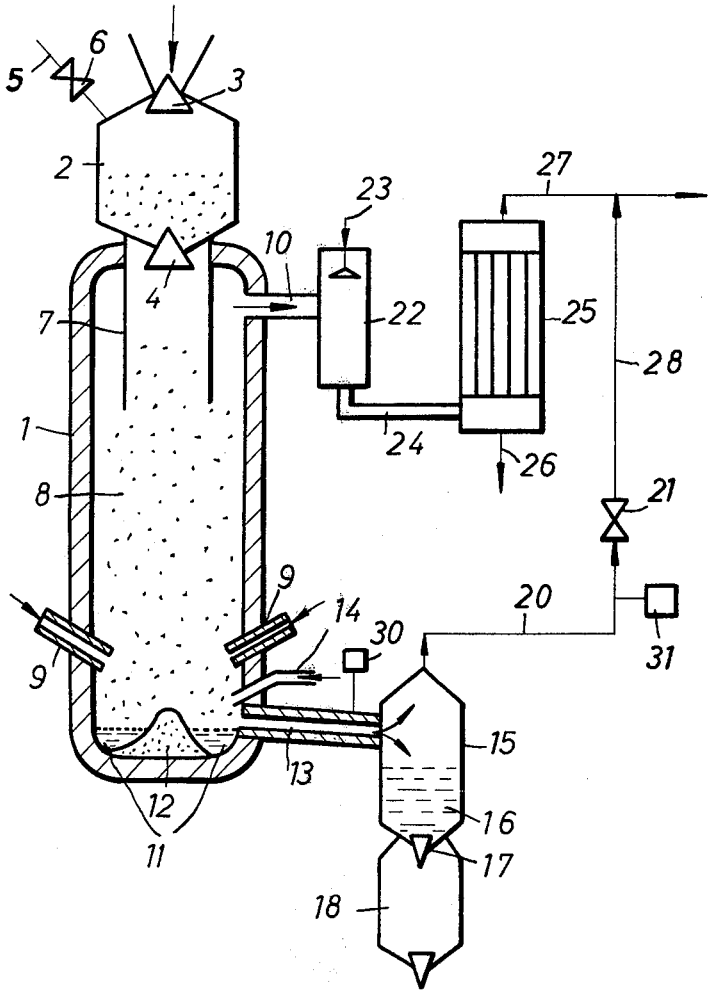
5
6
3
2
4
7
1
8
9
9
10
23
22
24
25
26
27
28
21
20
31
30
14
15
16
17
18
13
12
11

PROCESS FOR REMOVING SLAG DURING PRESSURE GASIFICATION OF SOLID FUELS

This invention relates to a process and apparatus for gasifying granular solid fossil fuels in a gasifying reactor under a pressure of about 10 to 100 bars, in which the fuels form in the reactor a fixed bed moving from top to bottom under gravity, oxygen-containing gases and water vapor are fed into the fuel bed through nozzles in the lower portion of the reactor, molten slag at a temperature of about 1350° to 1500° C. is discharged through a conduit which is inclined to the horizontal at an angle of 0° to about 45°, and product gas is withdrawn from the reactor above the fuel bed. The fuel to be gasified consists in most cases of coal or coke in a particle size range of about 2 to 50 mm, preferably about 5 to 40 mm.

This method of pressure gasifying solid fuel in conjunction with a discharge of molten slag is already known. Processes of this kind have been described by The Gas Council, London, and published in their Research Communications "GC 50" and "GC 112".

In the known pressure gasifying process, an oxygen-containing gas, such as air at high temperature, and water vapor, or a mixture of water vapor and oxygen, is blown through nozzles into the reactor chamber in which the fuel is disposed as a fixed bed. The resulting temperatures in the flame which is projected from the nozzles into the fuel bed are so high that the ash is melted and flows down to the bottom of the reactor. The temperatures at which the slag becomes sufficiently fluid lie generally in the range from about 1350° to 1600° C. and preferably in the range from about 1350° to 1600° C. and preferably in the range from about 1400° to 1500° C. Fluxes for the slag can be admixed with the fuel. In front of the blast nozzles, the oxygen is consumed at a very high rate as it reacts with the carbon of the fuel so that hot combustion gases are produced. For this reason the temperature in the flame formed by the gasifying agents lie at about or above 2000° C.

There is a surplus of carbon adjacent to the flame, and gasifying reactions by which the combustion products $CO_2$ and $H_2O$ are converted to CO and $H_2$ are initiated immediately. Outside the flame, a gas is quickly formed which has a composition corresponding to an equilibrium temperature of about 1200° to 1300° C. This means that the temperature of the gas atmosphere outside the flame adjacent to the blast nozzles is below the temperature at which ash is transformed into molten slag.

Two different methods can generally be adopted to prevent a cooling of the slag by the gasifying gas. In the first method, the slag is intermittently tapped from the reactor in that a slag tap adjacent to the bottom of the reactor is periodically opened to discharge slag into a lock chamber which contains a water bath. As soon as the surface level of the molten slag has been lowered to such an extent that relatively cold gas-in-process at a temperature of an order of 1200° C. flows out too through the slag discharge conduit. the latter is closed so that the slag in the slag discharge conduit cannot be cooled and solidified by the relatively cold gas-in-process.

In a second method of discharging slag, the slag discharge conduit is provided at the lowermost point of the bottom of the reactor and a mixture of oxygen and fuel gases is blown under superatmospheric pressure through the conduit into the reactor from below. The resulting combustion gases prevent an escape of slag and also heat the slag. The production of combustion gases is interrupted from time to time when it is desired to discharge slag so that the slag can then flow down through the conduit.

It is an object of the invention to improve the method of discharging molten slag. An intermittent operation is to be enabled but a continuous discharge of slag is to be enabled too. In the process described first hereinbefore this is accomplished in that high-oxygen gas is fed into the reactor adjacent to the inlet of the slag discharge conduit and is directed from above onto the molten slag, and leakage gas at a temperature of at least about 1500° C. is withdrawn through the slag discharge conduit co-currently with the slag. The auxiliary gas, which is referred to as a leakage gas, prevents a cooling of the molten slag in the slag discharge conduit to a temperature at which the slag solidifies.

The leakage gas includes combustion gas produced by an auxiliary burner, which is provided slightly above the inlet of the slag discharge conduit. Oxygen or air or a mixture of oxygen and water vapor is fed into the reactor through the auxiliary burner. Gas-in-process is burnt together with the oxygen at a corresponding rate and the resulting combustion gases are at a sufficiently high temperature, which is much higher than the melting point of the slag. Because the nozzle of the auxiliary burner is disposed slightly over the inlet of the slag discharge conduit, the combustion gas delivered by said nozzle flows prefererentially into the slag discharge conduit so that there are virtually no endothermic reactions within the fuel bed. As a result, molten slag is withdrawn on the bottom of the slag discharge conduit and hot leakage gas flowing co-currently with the slag contributes to maintain the slag in a molten condition.

The slag and the leakage gas are desirably transferred through the slag discharge conduit into a lock chamber vessel and the temperature of the leakage gas exceeds the temperature of the liquid slag throughout the length of the discharge conduit.

The process will be explained further with reference to the drawing, which is a diagrammatic longitudinal sectional view showing the gasification reactor and auxiliary equipment.

The reactor comprises a pressure housing 1 which has a brick lining in the embodiment shown in the drawing. Alternatively, the housing may be provided with a cooling water jacket. Granular fuel is charged into the reactor through a lock chamber 2, which is provided with valves 3 and 4. These valves can be opened and closed by means which are not shown, such as linkages. A conduit 5 which incorporates a valve 6 is provided for feeding and withdrawing gas, e.g. for pressure control.

The fuel first falls past the open valve 4 into an intermediate container 7 and from the latter into a reactor chamber 8, in which the fuel forms a subsiding fixed bed. A plurality of nozzles 9, usually more than two, are provided in the lower portion of the reactor and serve to blow mixed gasifying agents into the fuel bed. The gasifying agents usually consist of water vapor and an oxygen-containing gas. The volume ratio of water vapor to oxygen in the mixed gasifying agents is usually in the range of about 0.6:1 to 1.4:1.

The gases which are produced in the reactor chamber 8 with the aid of the gasifying agents rise countercurrent to the fuel bed and are withdrawn from the reactor through a product gas-withdrawing conduit 10. Molten slag is collected on the bottom of the reactor in a sump 11. During the gasifying process, a conical residual pile 12 of slag which has not been melted and of residue from fuel forms at the bottom of the reactor. This pile is described as "dead material".

Surplus molten slag can be continuously discharged through a slag discharge conduit 13, which consists of a tube that is joined to the side wall of the reactor near the reactor bottom and in most cases is inclined at an acute angle to the horizontal. An auxiliary burner 14 is provided to prevent solidification of the slag flowing in the slag discharge conduit 13. Oxygen or air and possibly also water vapor is blown by this auxiliary burner 14 into the reactor toward the slag sump 11 near the inlet of the discharge conduit 13. At least part of the resulting hot combustions gases flow through the slag discharge conduit 13 co-currently with the molten slag. The hot combustion gases, which may also be described as a leakage gas, prevent a disturbance of the discharge of slag.

The slag as well as the leakage gas flow from the discharge conduit 13 into a container 15, which contains a water bath 16. Molten slag falls into the water bath 16 and is granulated therein. The bottom valve 17 is actuated from time to time to withdraw slag and water from the container 15 through the intermediate container 18.

Leakage gas which has entered the container 15 through the slag discharge conduit 13 is withdrawn from the container 15 through a conduit 20 at a rate which can be controlled by adjusting the valve 21.

As has been explained, the product gas in withdrawn from the reactor chamber 8 through the withdrawing conduit 10 at temperatures of about 300° to 800° C. In known manner, aqueous absorbent from conduit 23 is sprinkled in a scrubber-cooler 22 on the product gas, which is thus cooled and saturated with water vapor. Used absorbent and the cooled product gas are then fed in conduit 24 to a waste heat boiler 25. Absorbent is withdrawn from the sump of the waste heat boiler through a conduit 26 and is subjected to further processing. Part of the absorbent is usually re-used. Cooled product gas is withdrawn from the wast heat boiler 28 through a conduit 27. Owing to the cooling which has been effected, the pressure in the conduit 27 is lower than in the conduit 20 so that the leakage gas can be added to the product gas through conduit 28 without need for an additional expenditure.

It has already been explained that temperature of the leakage gas flowing through the slag discharge conduit 13 must be at least as high as the temperature of the slag. The leakage gas temperature is preferably higher than the slag temperature. A thermocouple 30 for monitoring the temperature of the leakage gas is provided at the discharge conduit 13. It may be suitable to monitor also the composition of the leakage gas by means of a conventional gas analyzer 31. A change in the temperature of the leakage gas is accompanied by a change in the composition of the gas. Whereas the gas-in-process in the reactor chamber 8 consists mainly of CO and $H_2$, the leakage gas desirably has higher contents of $CO_2$ and $H_2O$. If the auxiliary burner is fed wth air, the nitrogen content of the leakage gas will be a measure of the proportion in the leakage gas of the gas produced by said burner. For this reason, the analyzer 31 may be used to measure the nitrogen content as an indication of whether or not hot gas flows at a sufficiently high rate from the auxiliary burner 14 through the conduit 13. When the nitrogen content of the gas in the conduit 20 is sufficiently significant, there is no need for a thermocouple 30 for controlling the auxiliary burner 14.

The following advantageous automatic control is enabled by the use of an auxiliary burner for producing a major portion of the leakage gas which flows through the discharge conduit 13 co-currently with the molten slag:

When a colder slag having a higher viscosity is being formed, a larger portion of the cross-sectional area in the conduit 13 is filled with slag so that the cross-section which is free for the flow of the leakage gas is decreased. At a given pressure difference between the reactor chamber 8 and the container 15, less leakage gas then flows through the conduit 13 so that the proportion of relatively cold gas-in-process in the leakage gas is decreased and the proportion of combustion gases from the auxiliary burner 14 is increased. The increase of the proportion of the combustion gases from the auxiliary burner results in a temperature rise of the leakage gas so that the viscosity of the slag in the conduit 13 decreases and the slag can be discharged more easily. In this way the leakage gas itself ensures that the free cross-sectional area through which it can flow in the slag discharge conduit 13 remains approximately constant. In the opposite case, when the slag in conduit 13 is too fluid, more leakage gas having a larger proportion of relatively cold gas-in-process flows co-currently with the slag.

The invention is further described in the following illustrative example:

EXAMPLE

In a pressure gasification plant as shown in the drawing, coal which contains 10% ash and 10% moisture and has a particle size range from 6 to 30 mm is gasified at a rate of 44 tons per hour. The gasification reactor has a brick-lined housing which has an inside diameter of 3.2 meters and an inside height of 10 meters. A mixture of oxygen at a rate of 12,000 standard cubic meters per hour and water vapor at a rate of 9.2 tons per hour is blown into the reaction chamber 8 through eight nozzles for distributing the gasifying agents. A pressure of 30 bars prevails in the reaction chamber. Water vapor-containing product gas at 450° C. is withdrawn from the reactor at a rate of 60,000 standard $m^3$ per hour and has the following composition in % by volume:

| | |
|---|---|
| $CO_2$ | 3.8 |
| CO | 57.5 |
| $H_2$ | 26.4 |
| $CH_4$ | 5.7 |
| $N_2$ | 1.0 |
| $H_2O$ | 5.6 |
| | 100.0 |

Molten slag at a temperature of 1430° C. collects on the bottom of the reactor. Adjacent to the coal bed above the slag and outside the flames projected from the gasifying agent nozzles, the gas-in-process is at a temperature of about 1250° C. Adjacent to the inlet of the slag discharge conduit 13, air at a rate of 100 standard $m^3$ per hour is blown into the reactor through the auxiliary burner 14.

The gas-in-process in the lower part of the gasification reactor has approximately the following composition in % by volume:

| | |
|---|---|
| $CO_2$ | 6.0 |
| CO | 64.0 |
| $H_2$ | 23.0 |
| $N_2$ | 1.0 |
| $H_2O$ | 6.0 |
| | 100.0 |

The stoichiometric combustion of this gas-in-process at a rate of 47.6 standard $m^3/h$ with air at a rate of 100 standard $m^3/h$ results in the production of combustion gas at a rate of 111 standard $m^3/h$. This combustion gas has the following composition in % by volume:

| | |
|---|---|
| $CO_2$ | 16.5 |
| $N_2$ | 71.1 |
| $H_2O$ | 12.4 |
| | 100.0 |

The combustion gas is at a temperature of about 2800° C. Under the assumed operating conditions, which are adjusted by the control valve 21, gas-in-process at a rate of 238 standard $m^3/h$ flows at a temperature of 1250° C. to conduit 13. The resulting leakage gas thus consists of mixed gases at a rate of 249 standard $m^2/h$ and at a mixed gas temperature of 1850° C. and has the following composition in % by volume:

| | |
|---|---|
| $CO_2$ | 9.3 |
| CO | 44.4 |
| $H_2$ | 15.6 |
| $N_2$ | 22.6 |
| $H_2O$ | 8.1 |
| | 100.0 |

This leakage gase ensures a continuous, undisturbed discharge of the slag out of the reactor. The rate at which leakage gas is withdrawn from the reactor is automatically controlled by means of a thermocouple 30 and the valve 21. The leakage gas which has been withdrawn is admixed with the cooled product gas flowing in conduit 27.

It will be appreciated that the instant specification and examples are set forth by way of illustration and not limitation, an that various modifications and changes may be made without departing from the spirit and scope of the present invention.

What we claim is:

1. In the pressure gasification of granular solid fossil fuel in a reactor wherein the fuel forms a fixed bed moving from top to bottom of the reactor under gravity, oxygen-containing gases and water vapor are fed as gasifying agents into the fuel bed through nozzles in the lower portion of the reactor, molten slag at a temperature of about 1350° to 1500° C. is discharged through a conduit which is inclined to the horizontal, and product gas is withdrawn from the reactor above the fuel bed, the improvement which comprises by auxiliary burner means positioned below said nozzles feeding oxygen gas separately and independently from said gasifying agents into the reactor adjacent to the inlet of the slag discharge conduit and directed from above onto the molten slag, thereby burning part of the product gas and forming a combustion gas which mixes with additional product gas to form a leakage gas at a temperature of at least about 1500° C. which leakage gas is withdrawn through the slag discharge conduit co-current with the slag into a lock chamber, the temperature of the leakage gas exceeding the temperature of the molten slag throughout the length of the slag discharge conduit and measuring the temperature or the composition of the leakage gas in the slag discharge conduit and using the measurement for controlling the rate at which the leakage gas is withdrawn and for determining the proportion of the combustion gas from the auxillary burner in the leakage gas.

2. A process according to claim 1, wherein leakage gas is withdrawn from the slag discharge conduit and admixed with the withdrawn product gas.

* * * * *